US006692122B2

(12) United States Patent
Park

(10) Patent No.: US 6,692,122 B2
(45) Date of Patent: Feb. 17, 2004

(54) SHEET FEEDING APPARATUS OF INK-JET PRINTER

(75) Inventor: Ju-hyun Park, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/161,681

(22) Filed: Jun. 5, 2002

(65) Prior Publication Data

US 2003/0107634 A1 Jun. 12, 2003

(30) Foreign Application Priority Data

Dec. 6, 2001 (KR) ..... 2001-76973

(51) Int. Cl.[7] ..... B41J 2/01
(52) U.S. Cl. ..... 347/104
(58) Field of Search ..... 347/104, 101, 347/108; 400/624; 271/270, 271, 274, 117, 118, 121, 124

(56) References Cited

U.S. PATENT DOCUMENTS 6,053,596 A * 4/2000 Nakano et al. ..... 347/15
6,390,463 B1 * 5/2002 Iwago ..... 271/118

* cited by examiner

*Primary Examiner*—Stephen D. Meier
*Assistant Examiner*—An H. Do
(74) *Attorney, Agent, or Firm*—Staas & Halsey LLP

(57) ABSTRACT

A sheet feeding apparatus of an ink-jet printer includes a cassette to accommodate sheets of paper detachably provided in a main body of the printer, a pickup roller rotating in close contact with the paper accommodated in the cassette to have the paper enter into the main body, and a buffer member to prevent damage of a pickup roller portion occurring when the pickup roller continuously performs a pickup operation when no paper remains in the cassette. The buffer member includes a guide portion provided in the cassette, a stop portion protruding from sides of the cassette to support end portions of the pickup roller when no paper remains in the cassette, a pad installed between the stop portion and the guide portion to slide, and an elastic unit to apply a restoration force pad opposite to a direction in which the paper is supplied into the main body of the printer.

19 Claims, 5 Drawing Sheets

SHEET FEEDING APPARATUS OF INK-JET PRINTER

CROSS-REFERENCE TO RELATED APPLICATIONS

This application claims the benefit of Korean Application No. 2001-76973, filed Dec. 6, 2001, in the Korean Industrial Property Office, the disclosure of which is incorporated herein by reference.

BACKGROUND OF THE INVENTION

1. Field of the Invention

The present invention relates to an ink-jet printer, and more particularly, to a sheet feeding apparatus of an ink-jet printer to provide sheets of paper loaded in a cassette to a main body of the printer.

2. Description of the Related Art

In general, ink-jet printers are output devices to print images or characters by injecting ink onto a sheet of paper while an ink cartridge mounted on a carriage reciprocates horizontally.

In the conventional ink-jet printers, paper is transferred according to one of two methods. First, a sheet feeding cassette in which sheets of paper are loaded is installed at an angle in the rear of the main body, so that the paper is transferred to a printing unit by a pickup roller, printed, and then ejected through a sheet exhaust unit disposed in front of the main body. Second, the sheet feeding cassette to load sheets of paper is located under the main body of the printer and the paper is transferred to the printing unit by the pickup roller and printed, and then ejected through the sheet exhaust unit located above the sheet feeding cassette. The sheet feeding cassette is detachably coupled to one side of the ink-jet printer and a plurality of sheets of paper are loaded therein.

In particular, in the ink-jet printer adopting the second method of transferring paper, the sheets of paper are supplied inside the ink-jet printer one by one as the pickup roller rotates while contacting the upper surface of the paper disposed at the top of a stack of paper in the sheet feeding cassette during printing. By repeating the sheet pickup step performed by the pickup roller, the number of papers loaded in the sheet feeding cassette decreases.

However, even when the number of papers loaded in the sheet feeding cassette is reduced, to have the sheet pickup operation continuously performed by the pickup roller, the pickup roller and the paper must contact each other. To meet this condition, a vertically acting force must be applied to the pickup roller or the paper so that the pickup roller is pressed against the paper or the paper is pressed against the pickup roller.

There are two methods of applying a vertical force to the pickup roller or the paper. First, the pickup roller is installed to be fixed at a predetermined position above the paper, and an elevating plate installed at the sheet feeding cassette to be capable of moving up and down closely presses the paper toward the pickup roller. Second, the pickup roller is closely pressed toward the stacked paper with the weight of the pickup roller assembly itself.

As the paper pickup operation is continuously performed by the pickup roller according to the above-described methods, even when all of the sheets have been fed and no paper remains, the pickup roller continues to perform the sheet feeding operation according to a printing signal. Thus, the pickup roller rotates in direct contact with the elevating plate or the sheet feeding cassette.

As a result, the pickup roller can be damaged by friction. Also, since an excess force is applied to a gear train of the pickup roller assembly connected to the pickup roller to transfer power, the gear train may be damaged.

Accordingly, it is an object of the present invention to provide a sheet feeding apparatus of an ink-jet printer having a buffer member to prevent the pickup roller from being damaged after all of the sheets of paper have been fed.

Additional objects and advantages of the invention will be set forth in part in the description which follows and, in part, will be obvious from the description, or may be learned by practice of the invention.

The foregoing and other objects of the present invention are achieved by providing a sheet feeding apparatus of an ink-jet printer in which sheets are provided in a main body of the printer, the apparatus including a cassette to accommodate the sheets of paper, detachably provided in the main body of the printer; a pickup roller portion to pick up the accommodated paper; a pickup roller rotating in contact with the picked-up paper to feed the paper into the main body; and a buffer member to prevent damage to the pickup roller portion occurring when the pickup roller continuously performs a pickup operation when all of the paper has been fed from the cassette, the buffer member including a guide portion provided in the cassette, a stop portion having first and second portions protruding from the cassette towards each other to support the pickup roller when all of the paper has been fed from the cassette, a pad installed between the stop portion and the guide portion to slide, and an elastic unit to apply a restoration force to the pad in a direction opposite to a direction in which the paper is supplied into the main body of the printer.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
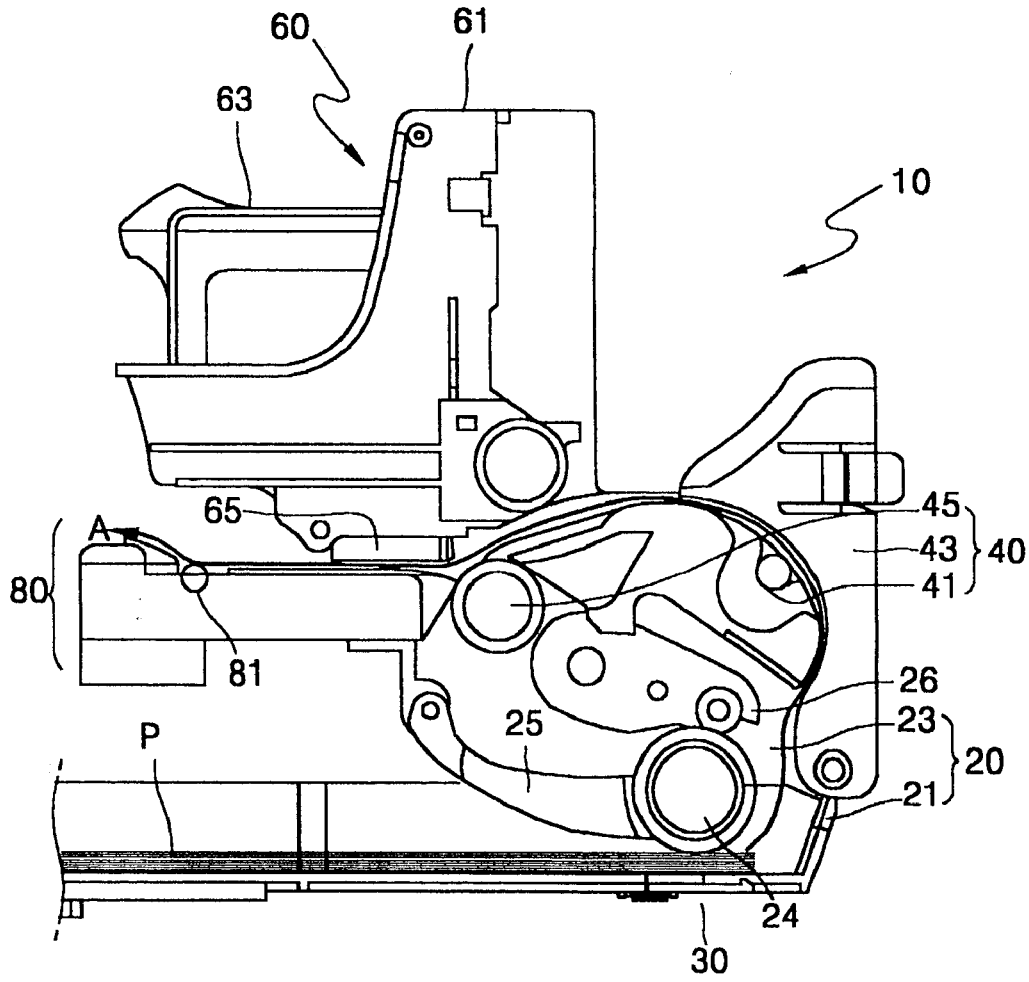
FIG. 1 is a sectional view of an ink-jet printer having a buffer member according to an embodiment of the present invention.

Reference will now be made in detail to the present preferred embodiments of the present invention, examples of which are illustrated in the accompanying drawings, wherein like reference numerals refer to like elements throughout.

Referring to FIG. 1, an ink-jet printer 10 according to an embodiment of the present invention includes a sheet feeding portion 20, a buffer member 30, a transfer portion 40, a printing portion 60, and a sheet exhaust portion 80.

The sheet feeding portion 20 supplies sheets of paper P into the ink-jet printer 10 and includes a sheet feeding cassette 21 installed at the lower portion of the ink-jet printer 10, and is capable of being inserted and ejected to load the paper P, and a pickup roller portion 23 installed above the sheet feeding cassette 21 to supply the paper P loaded in the sheet feeding cassette 21 into the ink-jet printer 10.

The pickup roller portion 23 picks up the paper P as a driving unit (not shown) generates power and the power is transferred to a pickup roller 24 via a gear train 26. The pickup roller 24 receives a vertical force from a support arm 25 so as to continuously contact the paper P. Also, a friction portion 24*a* (see FIG. 6A) having a relatively large frictional coefficient encircles the outer circumferential surface of the pickup roller 24 to allow the pickup roller 24 to easily pick up the paper P. Here, the friction portion 24*a* does not entirely cover the outer circumferential surface of the pickup roller 24. That is, a predetermined length from each of both end portions of the pickup roller 24 is not encircled by the friction portion 24*a*. This non-encircled portion forms a support portion 24*b* (see FIG. 7). According to an aspect of the present invention, the friction portion 24*a* is formed of rubber.

The transfer portion 40 transfers the paper P supplied by the sheet feeding portion 20 into the ink-jet printer 10 to the printing portion 60. The transfer portion 40 includes a transfer roller 41 to transfer the paper P supplied from the sheet feeding portion 20, a guide 43 to guide the paper P to be transferred to the printing portion 60, and a feed roller 45 to transfer the paper P to the printing portion 60.

The printing portion 60 performs a predetermined printing job onto the transferred paper P with an ink-jet head 65, by linear reciprocation of a carriage 61 by a driving unit (not shown), on which an ink cartridge 63 is mounted.

The sheet exhaust portion 80 installed above the sheet feeding portion 20 includes a sheet exhaust roller 81 to exhaust the paper P printed by the printing portion 60 to be stacked in a sheet exhaust tray (not shown).

The buffer member 30 is installed on the sheet feeding cassette 21 to face the pickup roller 24. Although FIG. 1 illustrates one buffer member 30, a plurality of the buffer members 30 may also be installed. The buffer member 30 contacts the pickup roller 24 when no paper remains in the sheet feeding cassette 21 to prevent the case in which the pickup roller 24 rotates in direct contact with the sheet feeding cassette 21.

Figure 2:
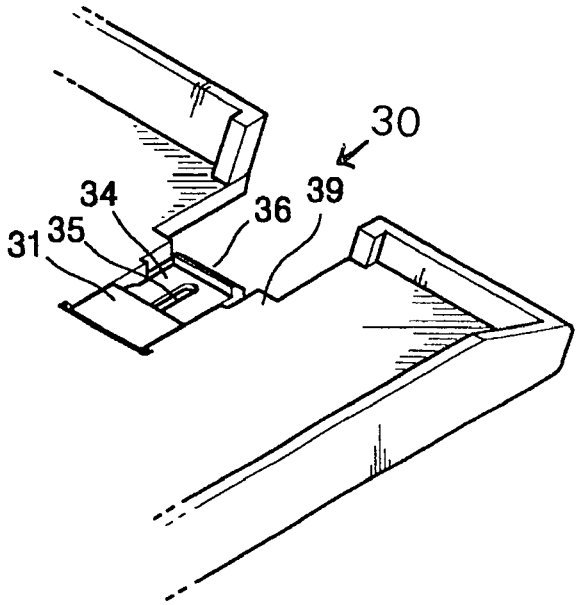
FIG. 2 is a perspective view of the buffer member shown in FIG. 1.
Figure 3:
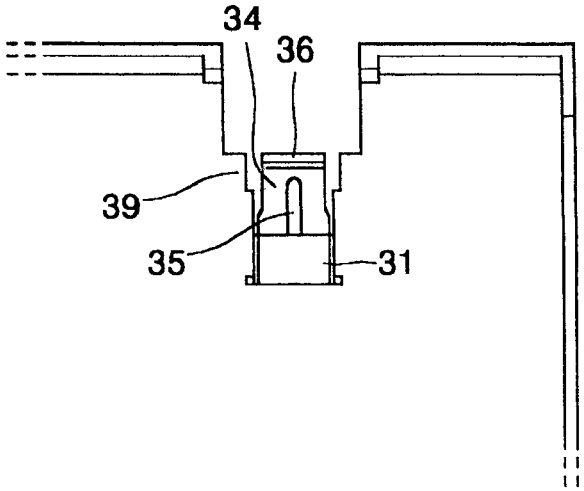
FIG. 3 is a plan view of the buffer member shown in FIG. 1.
Figure 4:
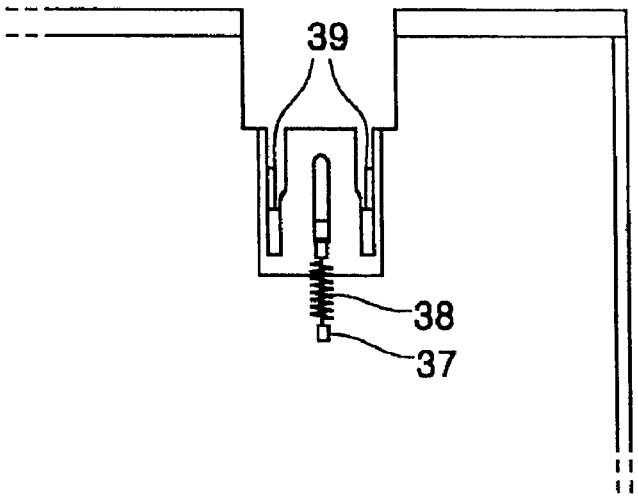
FIG. 4 is a rear view of the buffer member shown in FIG. 1.

Referring to FIGS. 2 through 4, the buffer member 30 includes a pad 31, a guide portion 34, an elastic unit 38, and a stop portion 39.

Figure 5:
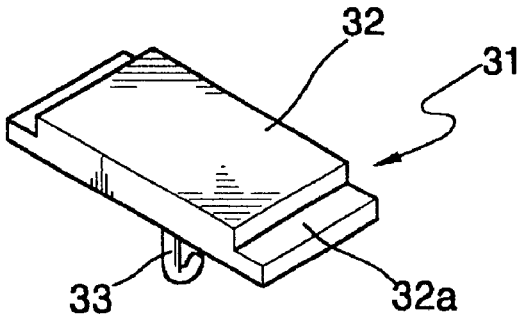
FIG. 5 is a perspective view of the pad shown in FIG. 1.

FIG. 5 is a perspective view showing the pad 31 of FIG. 2. Referring to FIG. 5, the pad 31 includes a contact portion 32 having a predetermined frictional coefficient provided on the upper surface thereof, and a first hook portion 33 to fix the elastic unit 38 (described later) provided on the lower surface thereof, so that the paper P directly contacts the rotating pickup roller 24 when no paper remains in the sheet feeding cassette 21.

The contact portion 32 does not cover the entire upper surface of the pad 31 and retreats a predetermined length inwardly from each of end portions of the pad 31. A hook step 32*a* is formed by the retreated portion of the contact portion 32, and is supported by the stop portion 39 (described later).

The guide portion 34 guides a linear reciprocating movement of the pad 31 and includes a guide slot 35 into which the first hook portion 33 is inserted, and a restriction portion 36 provided at the rear of the guide portion 34 to restrict the linear movement of the pad 31 within a predetermined range.

The guide portion 34 may be formed integrally with the sheet feeding cassette 21 or formed separately and installed at the sheet feeding cassette 21.

The elastic unit 38 has one side connected to the first hook portion 33 and another side connected to a second hook portion 37 provided at the lower surface of the sheet feeding cassette 21. According to an aspect of the present invention, the elastic unit 38 is a tension spring.

The stop portion 39 extends from the left and right sides toward the guide slot 35 and is installed above the guide portion 34. The pad 31 is inserted between the stop portion 39 and the guide portion 34 to be capable of sliding. That is, the first hook portion 33 of the pad 31 is inserted into the guide slot 35 and the hook step 32*a* is supported by the stop portion 39.

Also, when no paper remains in the sheet feeding cassette 21, the friction portion 24*a* of the pickup roller 24 is disposed between the sides of the stop portion 39. As the support portion 24*b* is supported by the stop portion 39, the pickup roller 24 is prevented from further downward movement toward the sheet feeding cassette 21 (refer to FIG. 7).

The operation of the ink-jet printer 10 having the buffer member 30 of the pickup roller 24 having the above structure is described below with reference to the drawings.

Figure 6A:
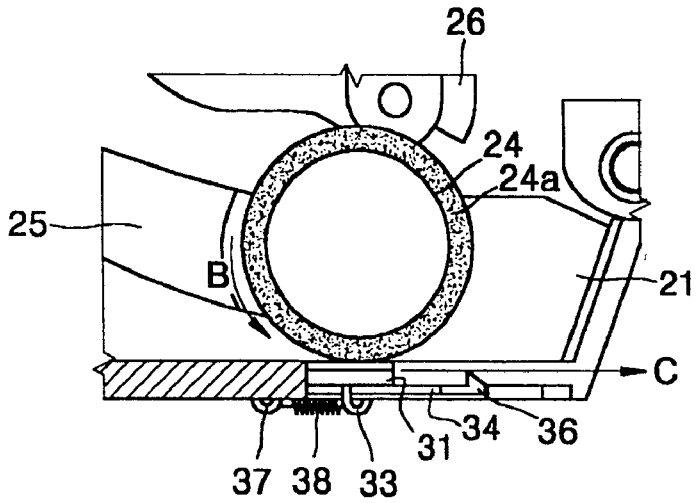
FIGS. 6A through 6C are views showing the operation of the buffer member shown in FIG. 1.
Figure 6B:
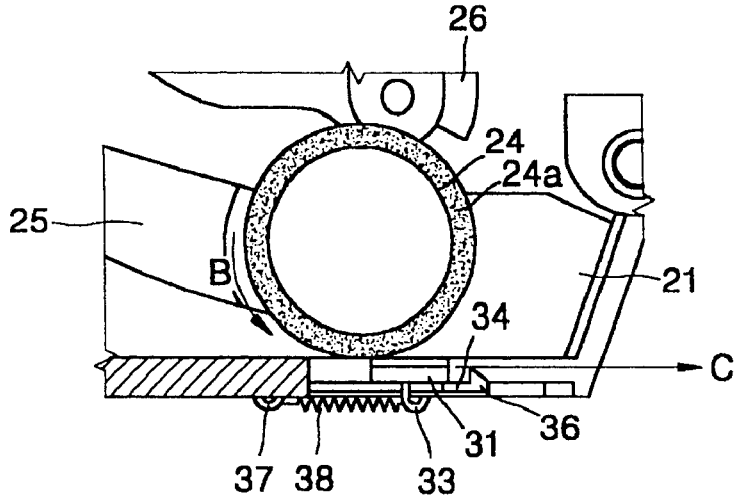
Figure 6C:
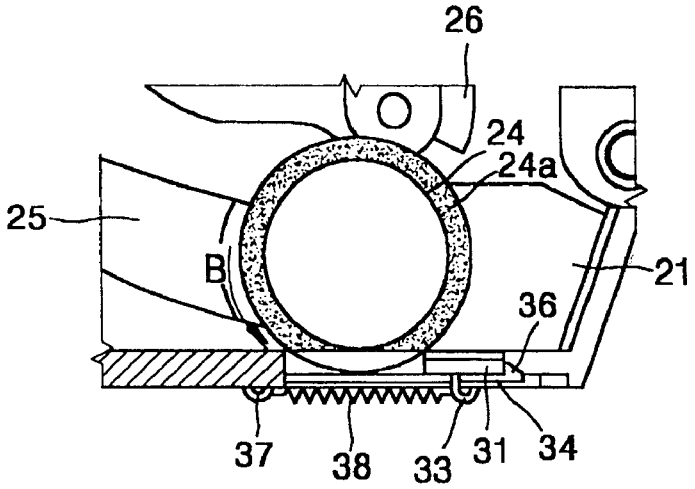
Figure 7:
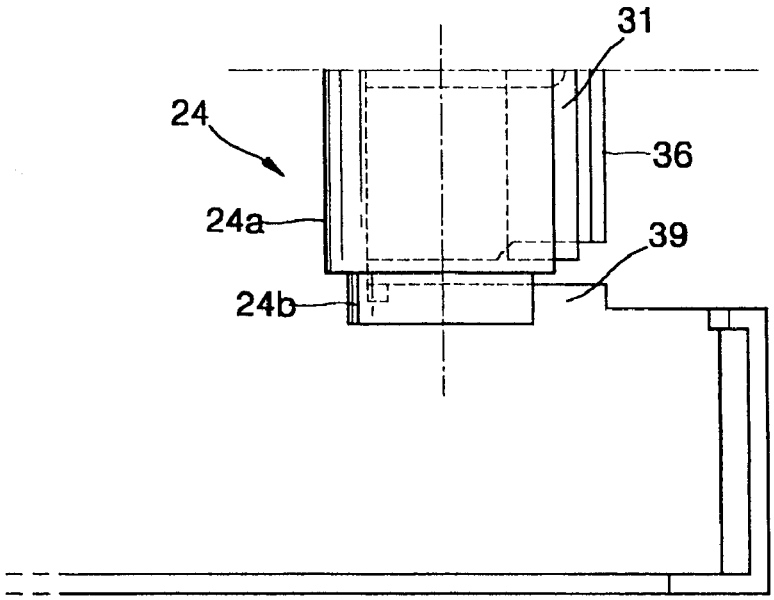
FIG. 7 is a plan view showing the operation of a pickup roller and a stop portion of the ink-jet printer shown in FIG. 1.

FIGS. 6A through 6C are views for explaining the operation of the buffer member 30 according to the present invention. FIG. 7 shows the operational relationship between the pickup roller 24 and the stop portion 39.

First, referring to FIG. 6A, when print data is transferred to the ink-jet printer 10 in the case in which no paper remains in the sheet feeding cassette 21, the pickup roller 24 rotates in a direction 'B' to pickup the paper P. Here, since there is no paper P in the sheet feeding cassette 21, the friction portion 24*a* contacts the contact portion 32 and rotates.

Since the friction portion 24*a* and the contact portion 32 have predetermined frictional coefficients, a friction force acts on the respective contact surfaces so that the pad 31 is moved in a direction 'C' of FIG. 6A.

As the pad 31 moves in the direction 'C', the pickup roller 24 is continuously lowered toward the paper P by a vertical force applied by the support arm 25. However, as shown in FIGS. 6C and 7, as the support portion 24*b* contacts the stop portion 39, the pickup roller 24 is prevented from further lowering. Thus, since the friction portion 24*a* provided at both end portions of the pickup roller 24 is disposed between the support portions 24*b*, the pickup roller 24 rotates in contact with only one side of the contact portion 32, without contacting other parts. Here, the force acting between the friction portion 24*a* and the contact portion 32 is a very small force that only minimally affects the rotation speed of the pickup roller 24. Therefore, an excess force does not affect the gear train 26 of the pickup roller portion 23.

In the meantime, the pad 31 is prevented from being further moved by being restricted by the restriction portion 36. The elastic unit 38 stores a deformation energy during expansion due to the movement of the pad 31.

When a user loads the paper P in the sheet feeding cassette 21, the paper P is supplied between the pickup roller 24 and the pad 31, and the pickup roller 24 and the pad 31 are separated from each other. Then, the pad 31 returns to the original position by the elastic unit 38 and the pick up roller 24 continues to pickup the paper P.

As described above, in the sheet feeding apparatus of the ink-jet printer 10 according to the present invention, when no paper remains in the sheet feeding cassette 21, the pickup roller 24 does not directly contact the sheet feeding cassette 21 and rotates while receiving a minimum amount of frictional force. Thus, damage to the pickup roller 24 and abrasion of the gear train 26, which transfers power to the pickup roller 24 can be minimized.

Although a preferred embodiment of the present invention has been shown and described, it will be appreciated by those skilled in the art that changes may be made in these embodiments without departing from the principles and spirit of the invention, the scope of which is defined in the claims and their equivalents.

What is claimed is:

1. A sheet feeding apparatus of an ink-jet printer in which sheets are provided in a main body of the printer, the apparatus comprising:

a cassette to accommodate the sheets of paper, provided in the main body of the printer;

a pickup roller portion to pick up the accommodated paper;

a pickup roller to rotate in contact with the picked-up paper to feed the paper into the main body; and a buffer member to prevent damage to the pickup roller occurring when the pickup roller continuously performs a pickup operation when all of the paper has been fed from the cassette, the buffer member comprising:

a guide portion provided in the cassette, a stop portion having first and second portions protruding from the cassette towards each other to support the pickup roller when all of the paper has been fed from the cassette, a pad installed between the stop portion and the guide portion to slide, and an elastic unit to apply a restoration force to the pad in a direction opposite to a direction in which the paper is supplied into the main body of the printer.

2. The sheet feeding apparatus as claimed in claim 1, wherein the pad comprises:

a first portion;

second and third portions on opposite sides of the first portion;

first and second hook steps respectively provided on upper surfaces of the second and third portions and supported by the stop portion;

a contact portion provided on an upper surface of the first portion and in contact with the pickup roller; and a first hook portion provided on a lower surface of the pad and connected to the elastic unit.

3. The sheet feeding apparatus as claimed in claim 1, wherein the guide portion forms a guide hole along which the pad slides.

4. The sheet feeding apparatus as claimed in claim 1, wherein the elastic unit is a tension spring.

5. The sheet feeding apparatus as claimed in claim 1, wherein:

the pad comprises a first hook portion on a lower surface thereof, the first hook portion is inserted into the guide portion to guide the pad therein, and the guide portion comprises a restriction portion to restrict the sliding of the pad.

6. The sheet feeding apparatus as claimed in claim 1, wherein the guide portion is formed integrally with the cassette.

7. The sheet feeding apparatus as claimed in claim 1, wherein the guide portion is formed separately from and installed at the cassette.

8. The sheet feeding apparatus as claimed in claim 5, wherein the cassette comprises a second hook portion provided at a lower surface thereof, and the elastic unit comprises:

a first side connected to the first hook portion, and a second side connected to the second hook portion.

9. A sheet feeding apparatus to feed sheets of paper in an inkjet printer, the apparatus comprising:

a cassette to accommodate the sheets of paper;

a roller to rotate in contact with the paper to feed the paper from the cassette into the printer; and a buffer member to move in response to the rotation of the roller when all of the paper has been fed from the cassette and thereby reduce a frictional force on the roller from the buffer member.

10. The sheet feeding apparatus as claimed in claim 9, wherein the buffer member prevents direct contact of the roller and the cassette.

11. The sheet feeding apparatus as claimed in claim 9, wherein the buffer member further comprises:

a pad to contact the roller;

first and second stop portions protruding from the cassette towards each other to support the roller when all of the paper has been fed from the cassette; and an elastic unit to apply a restoration force to the pad in a direction opposite to a direction in which the paper is supplied into the printer.

12. The sheet feeding apparatus as claimed in claim 11, wherein the roller comprises:

a friction portion to contact the paper; and first and second support portions recessed relative to the friction portion on opposite sides of the friction portion to contact the first and second stop portions, respectively.

13. The sheet feeding apparatus as claimed in claim 12, wherein the pad comprises:

a first portion;

second and third portions on opposite sides of the first portion;

first and second hook steps respectively provided on upper surfaces of the second and third pad portions and supported by the stop portion;

a contact portion provided on an upper surface of the first portion and in contact with the roller; and a first hook portion provided on a lower surface of the pad and connected to the elastic unit.

14. The sheet feeding apparatus as claimed in claim 13, wherein the friction portion contacts the contact portion of the pad when all of the paper has been fed from the cassette, and the rotation of the roller causes the pad to slide.

15. The sheet feeding apparatus as claimed in claim 14, wherein the elastic unit applies the restoration force to the pad in a direction opposite to a direction of sliding of the pad.

16. The sheet feeding apparatus as claimed in claim 13, wherein the stop portions contact the support portions to prevent a lowering of the roller.

17. A sheet feeding apparatus to feed sheets of paper in an ink-jet printer, the apparatus comprising:

a cassette to accommodate the sheets of paper;

a roller to rotate in contact with the paper to feed the paper from the cassette into the printer; and a buffer member to prevent damage to the roller due to an excess frictional force on the roller from the cassette when all of the paper has been fed from the cassette.

18. A sheet feeding apparatus to feed sheets of paper in an inkjet printer, the apparatus comprising:

a cassette to accommodate the sheets of paper;

a gear train;

a roller to rotate in contact with the paper to feed the paper from the cassette into the printer in response to a force from the gear train; and a buffer member to prevent damage to the gear train due to an excess frictional force on the roller from the cassette when all of the paper has been fed from the cassette.

19. An ink-jet printer, comprising:

a main body; and a sheet feeding apparatus to feed sheets of paper into the main body, comprising:

a cassette to accommodate the sheets of paper, a roller to rotate in contact with the paper to feed the paper into the main body, and a buffer member to move in response to the rotation of the roller when all of the paper has been fed from the cassette, and thereby reduce a frictional force on the roller from the buffer member.

* * * * *